US005596391A

United States Patent [19]

Matsushita et al.

[11] Patent Number: 5,596,391

[45] Date of Patent: Jan. 21, 1997

[54] IMAGE FORMING APPARATUS HAVING TRANSFER CONSTANT CURRENT SOURCE ADJUSTABLE IN RESPONSE TO THE THICKNESS OF DIELECTRIC LAYER

[75] Inventors: Kouji Matsushita; Yasuhiro Nakagami; Noboru Yonekawa, all of Toyokawa, Japan

[73] Assignee: Minolta Co., Ltd., Osaka, Japan

[21] Appl. No.: 529,098

[22] Filed: Sep. 15, 1995

[30] Foreign Application Priority Data

Sep. 21, 1994 [JP] Japan ..... 6-227110

[51] Int. Cl.[6] ..... G03G 21/00

[52] U.S. Cl. ..... 399/45; 399/159; 399/318

[58] Field of Search ..... 355/208, 271, 355/274, 275, 211, 212, 219

[56] References Cited

U.S. PATENT DOCUMENTS 3,910,697 10/1975 Lanker .
4,132,548 1/1979 Nagai et al. .
5,485,248 1/1996 Yano et al. ..... 355/206

FOREIGN PATENT DOCUMENTS 01-082052 3/1989 Japan .
2-264987 10/1990 Japan .
2-272590 11/1990 Japan .
05-241428 9/1993 Japan .
06-230650 8/1994 Japan .

*Primary Examiner*—Robert Beatty
*Attorney, Agent, or Firm*— Brinks Hofer Gilson & Lione

[57] ABSTRACT

An image forming apparatus, including a laminate image-bearing member having a dielectric layer or photoconductive layer, superimposed on an electrically conductive substrate, a transfer member for making pressure contact with said image-bearing member, and a cleaning member for cleaning the surface of said image-bearing member through contact therewith, forms an electrostatic latent image on said image-bearing member, develops said latent image into a visible toner image, and transfers said toner image from said image-bearing member to a transfer sheet passing through a contact-pressure nip portion between said image-bearing member and a transfer member by applying a controlled constant-current regulated transfer bias voltage to said transfer member. Where the transfer member is narrower than the dielectric layer, or photoconductive layer, of the image-bearing member and the width of the cleaning member so as to be arranged within said widths, a controller changes the transfer current of constant-current regulated transfer bias in accordance with the thickness of the dielectric layer or photoconductive layer of the image-bearing member.

28 Claims, 5 Drawing Sheets

IMAGE FORMING APPARATUS HAVING TRANSFER CONSTANT CURRENT SOURCE ADJUSTABLE IN RESPONSE TO THE THICKNESS OF DIELECTRIC LAYER

BACKGROUND OF THE INVENTION

1. Field of the Invention

The present invention relates to an image forming apparatus for copiers, facsimiles and the like, and more specifically relates to an image forming apparatus including a laminate image-bearing member comprising a dielectric layer or photoconductive layer superimposed on an electrically conductive substrate, a transfer member for making pressure contact with the image-bearing member, and a cleaning member for cleaning the surface of the image-bearing member through contact therewith, in which an electrostatic latent image is formed on the image-bearing member, and is developed into a visible toner image, and the visible toner image is transferred from the image-bearing member to a transfer sheet passing through a contact-pressure portion between said image-bearing member and a transfer member by applying a constant-current regulated transfer bias voltage to the transfer member.

2. Description of the Related Art

An image forming apparatus provided with a laminate image-bearing member, comprising a dielectric layer or photoconductive layer superimposed on an electrically conductive substrate, and with a transfer member, which comes into pressure contact with the image-bearing member, an electrostatic latent image is formed on the surface of the image-bearing member, and the electrostatic latent image is developed into a visible toner image, which is transferred from said image-bearing member to a transfer sheet while passing through the pressure contact surfaces of the image-bearing member and transfer member, i.e., the contact-pressure nip portion between the image-bearing member and the transfer member, by applying a constant-current regulated transfer bias voltage to said transfer member, and is fixed on the transfer sheet by a fixing means to produce an image.

An example of such an image forming apparatus is described hereinafter with reference to FIG. 4. The image forming apparatus of FIG. 4 is a printer, and is provided with a photosensitive drum 1 rotatably driven in the direction of arrow "a" by a drive means not shown in the drawing. Arranged sequentially around the periphery of photosensitive drum 1 are a charger 11, a developing device 12, a transfer roller 2, a cleaning blade 3, and an eraser 13. An image exposure unit 14 is arranged above photosensitive drum 1. A timing roller 15, is provided on one side of transfer roller 2, and a transfer sheet transport deck 16 and fixing roller 17 are, respectively, provided on the other side of transfer roller 2.

When printing, the surface of photosensitive drum 1 is uniformly charged by charger 11, and an electrostatic latent image is formed on the charged region via optical exposure of the drum surface by laser light L emitted from image exposure unit 14 in accordance with a document image. The formed latent image is developed by developing device 12 so as to form a visible toner image. In addition, a transfer sheet S is fed from a supply unit not shown in the drawing, and is transported via timing roller 15 to a transfer section synchronously with the toner image formed on the surface of photosensitive drum 1. In the transfer section, a transfer bias voltage is supplied from transfer bias power source 21 to transfer roller 2 so as to transfer the toner image onto transfer sheet S. After the toner image is transferred, transfer sheet S is transported to fixing roller 17 via transport deck 16, whereupon the toner image is fixed onto transfer sheet S and sheet S is subsequently discharged from the apparatus. Residual toner remaining on the surface of photosensitive drum 1 is removed therefrom by cleaning blade 3, and the residual charge on said drum surface is eliminated by eraser 13.

In the aforesaid image forming apparatus, the method of applying a transfer bias to a contact type transfer member such as transfer roller 2 may be a constant-voltage regulation method, or a constant-current regulation method. In the constant-voltage regulation method, the transfer current applied to the transfer sheet changes with differences in the thickness of the transfer sheet and varies depending on the type of sheet, i.e., when the electrical resistance of the transfer sheet changes, it influences image transfer effectiveness. Compared to transfer insufficiency which occurs in the aforesaid method, in the constant-current regulation method, a voltage is applied which is adjusted to the thickness of various transfer sheets, such that suitable image transfer is achieved without fluctuation in transfer efficiency because a constant transfer current normally results.

However, when a constant-current regulation method is used, and the edge portion of the transfer member 2 exceeds the width of the transfer sheets because of the width dimension of the transfer sheet, and the edge portion of said transfer member makes direct pressure contact with the image-bearing member 1, in the portion of the transfer member in direct pressure contact with the image-bearing member, a significant current flows past the transfer sheet with the result that the voltage required for transfer is reduced, thereby increasing the aforesaid transfer insufficiency.

Japanese Unexamined Patent Application No. HEI2-272590, for example, discloses a transfer method wherein the transfer current supplied by a constant-current regulated transfer bias changes in accordance with the width of a transfer sheet, such that a uniform charge is applied per unit area of the transfer sheet regardless of the width of said transfer sheet, thereby achieving a suitable transfer.

When a constant-current regulation method is used, the load resistance changes depending on the type of transfer sheet, e.g., an overhead projector (OHP) transparency, plain paper transfer sheet and the like, and the applied transfer voltage differs even though the transfer current is identical. FIG. 5 shows an example of changes in transfer characteristics (transfer efficiency), and voltage/current characteristics by type of transfer sheet in the laser printer of FIG. 4 when the system speed (circumferential speed of photosensitive drum 1) is set at 38 m/sec. In FIG. 5, "noiji 80T" and "OHP" represent types of transfer sheets. Reference label IW represents characteristics when a white document (no toner present) is used, and reference label IB represents characteristics when a solid image document is used. Reference label IPC represents the voltage/current characteristics without a transfer sheet when the current flows directly to photosensitive drum 1. As can be understood from FIG. 5, the applied transfer voltage differs even when the optimum transfer current is identical.

To eliminate the previously described problem, Japanese Unexamined Patent Application No. HEI2-264987, for example, discloses a transfer method wherein the transfer current of a constant-current regulated transfer bias changes in accordance with the type of transfer sheet so as to thereby suitably regulate a transfer voltage to achieve better transfer.

The disadvantages described below occur even when the transfer voltage of a constant-current regulated transfer bias is changed in accordance with the type and width of a transfer sheet as previously mentioned.

When, for example, a cleaning means for cleaning residual toner remaining on the surface of the image-bearing member after a toner image is transferred to a transfer sheet, such as a cleaning blade, cleaning brush or the like, comes into contact with the surface of the image-bearing member, the dielectric layer or photoconductive layer of the image-bearing member becomes gradually worn after repeated image formations, and the thickness of the layer is reduced by a considerable amount. The change in dielectric layer thickness occurs not only by the cleaning means but also through contact with the transfer member and transfer sheet. When the voltage applied to the transfer member is constant, the transfer current increases as the aforesaid layer thickness is reduced. FIG. 6 shows the change in optimum transfer current relative to change in the layer thickness of the photosensitive member in the condition wherein a transfer voltage of 1 kV is applied to transfer roller 2 in the laser printer of FIG. 4.

Accordingly, the previously described disadvantages do not result from changes in the transfer current in accordance with transfer sheet width or type of transfer sheet, and when the layer thickness of the photosensitive member changes, the previously set optimum current value changes and is not the desired value for image transfer, thereby resulting in transfer insufficiency.

In addition, when the edge portion of a transfer member exceeds the width of a transfer sheet, or medium, and makes direct pressure contact with the image-bearing member, a change in the ratio of the resistance value at the location in direct contact and the resistance value at the location in contact with the transfer sheet occurs, such that the current flowing through the location in direct contact increases, and the transfer current flowing through the transfer sheet decreases so as to cause at times obvious transfer insufficiency.

In order to eliminate the previously described disadvantages, an object of the present invention is to provide an image forming apparatus capable of accomplishing suitable image transfer without regard to changes in layer thickness of the dielectric layer or photoconductive layer of an image-bearing member.

SUMMARY OF THE INVENTION

The present invention provides an image forming apparatus which includes a laminate image-bearing member comprising a dielectric layer or photoconductive layer superimposed on an electrically conductive substrate, a transfer member for making pressure contact with said image-bearing member, and a cleaning member for cleaning the surface of said image-bearing member through contact therewith; and which forms an electrostatic latent image on the said image-bearing member, develops the latent image into a visible toner image, and transfers the toner image from the image-bearing member to a transfer sheet passing through a contact-pressure nip portion between the image-bearing member and a transfer member by applying a constant-current regulated transfer bias to said transfer member wherein at least suitable toner image transfer is accomplished regardless of changes in layer thickness of the dielectric layer or photoconductive layer of the image-bearing member, and regardless of the width dimension of the transfer sheet; and which can clean the surface of the image-bearing member after the image transfer using the cleaning member.

DESCRIPTION OF THE PREFERRED EMBODIMENTS

Figure 4:
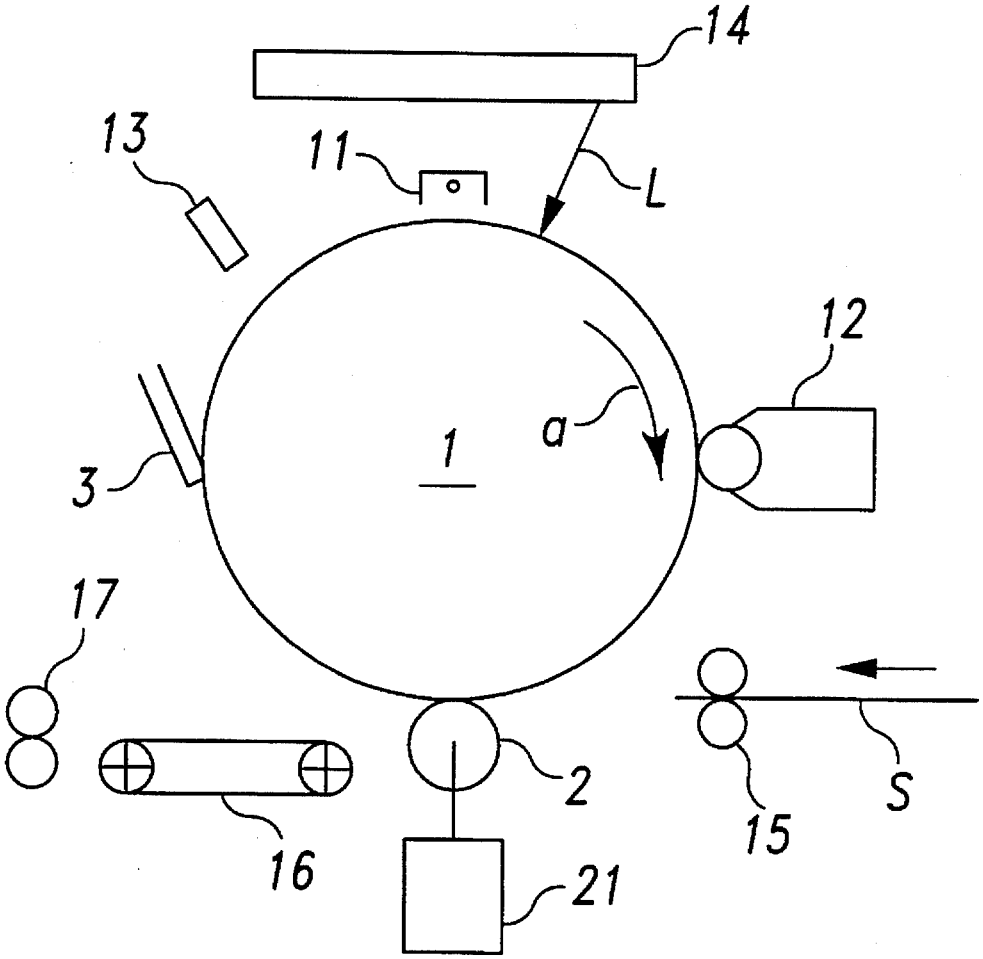
(PRIOR ART) Fig. 4
FIG. 4 diagrammatically shows the construction of a conventional prior art printer.
Figures 5A, 5B:
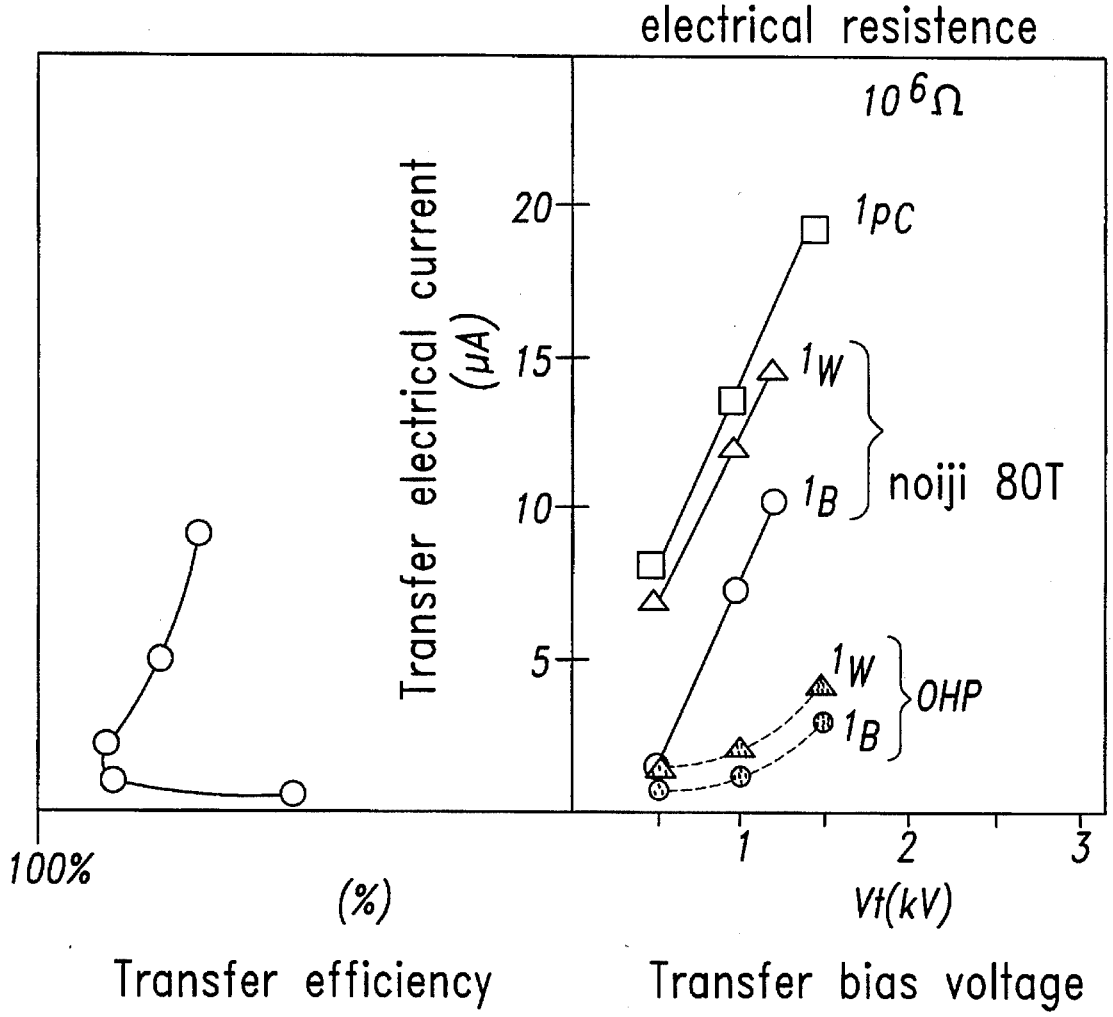
FIG. 5 shows, in its left portion, an example of changes in transfer characteristics (transfer efficiency) with transfer current and in its right portion, voltage/current characteristics by type of transfer sheet.
Figure 6:
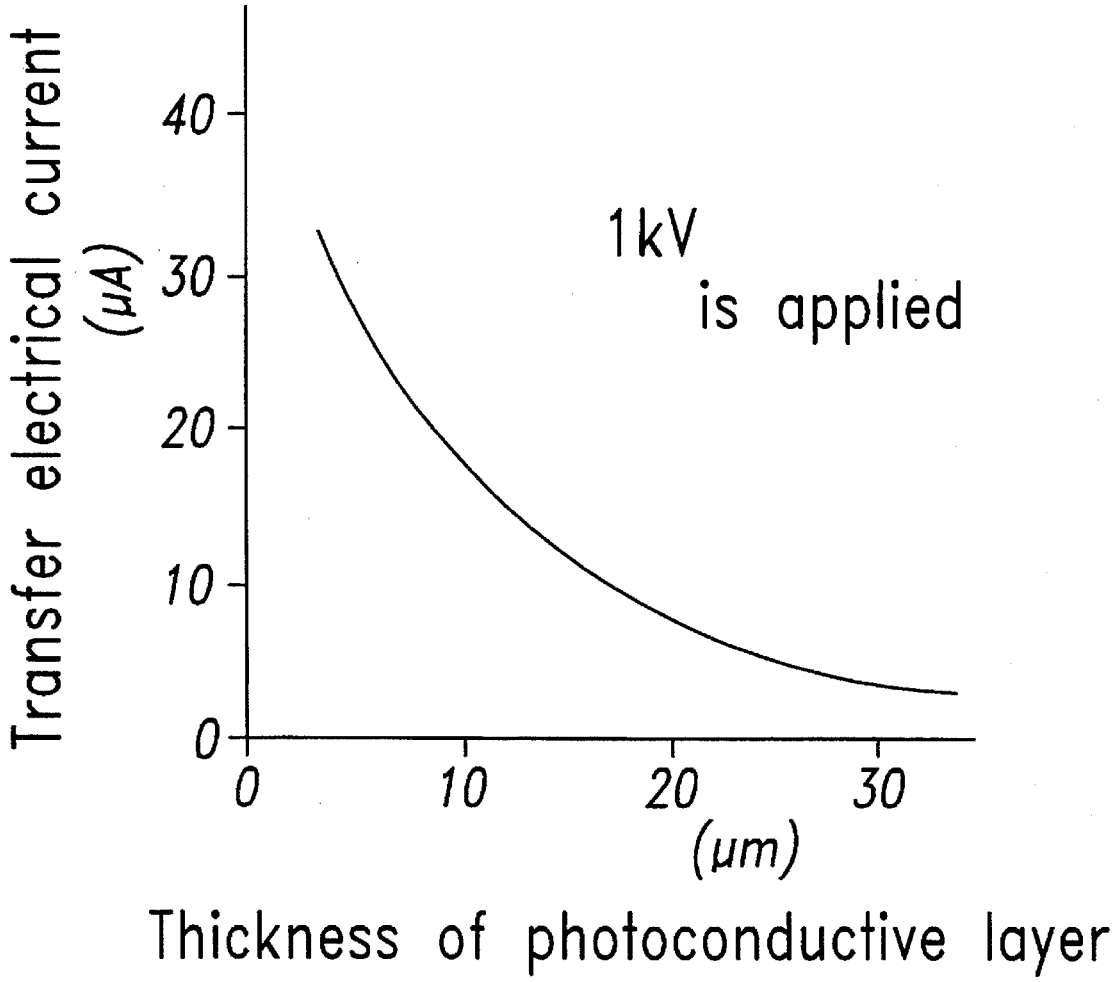
FIG. 6 shows an example of changes in transfer current relative to changes in photosensitive layer thickness.

The printer shown in FIG. 1 has essentially the same construction as the conventional printer of FIG. 4. Like parts are designated by like reference numbers in the drawings.

The items labeled in the several drawings are: 10 - an image-bearing member; 10*a* - an electrically conductive substrate of the image-bearing member 10; 10*b* - a dielectric or photoconductive layer of the image-bearing member 10; 20 - a transfer member or roller; 200 - a constant-current regulated power source; 30 - a cleaning member or blade; CONT - a control unit or means for controlling transfer current; S - a transfer sheet or medium; W1 - the width of photosensitive or photoconductive layer 10*b*; W2 - the width of transfer member or roller 20; and W3 - the width of cleaning member or blade 30.

The image forming apparatus of the present invention is identical to conventional image forming apparatus insofar as the surface of the image-bearing member is charged by a charger, the charged surface is optically exposed by image light corresponding to a document image emitted from an image exposure unit so as to form an electrostatic latent image on said charged surface; the latent image is developed into a visible toner image via a developing device; and the toner image is transferred onto a transfer sheet via a transfer member in a transfer section; the transfer image is fixed via a fixing device; and the toner image transfer to the transfer sheet is accomplished by applying to the transfer member a constant-current regulated transfer bias.

Figure 1A:
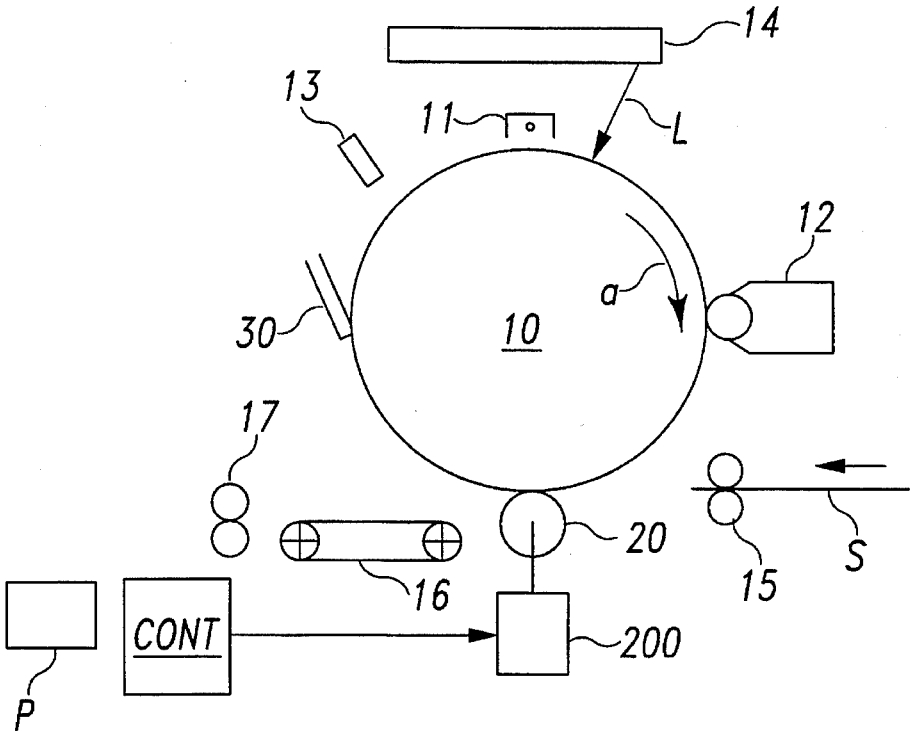
FIG. 1(A) diagrammatically shows the construction of a printer in a first embodiment of the present invention.
Figure 1B:
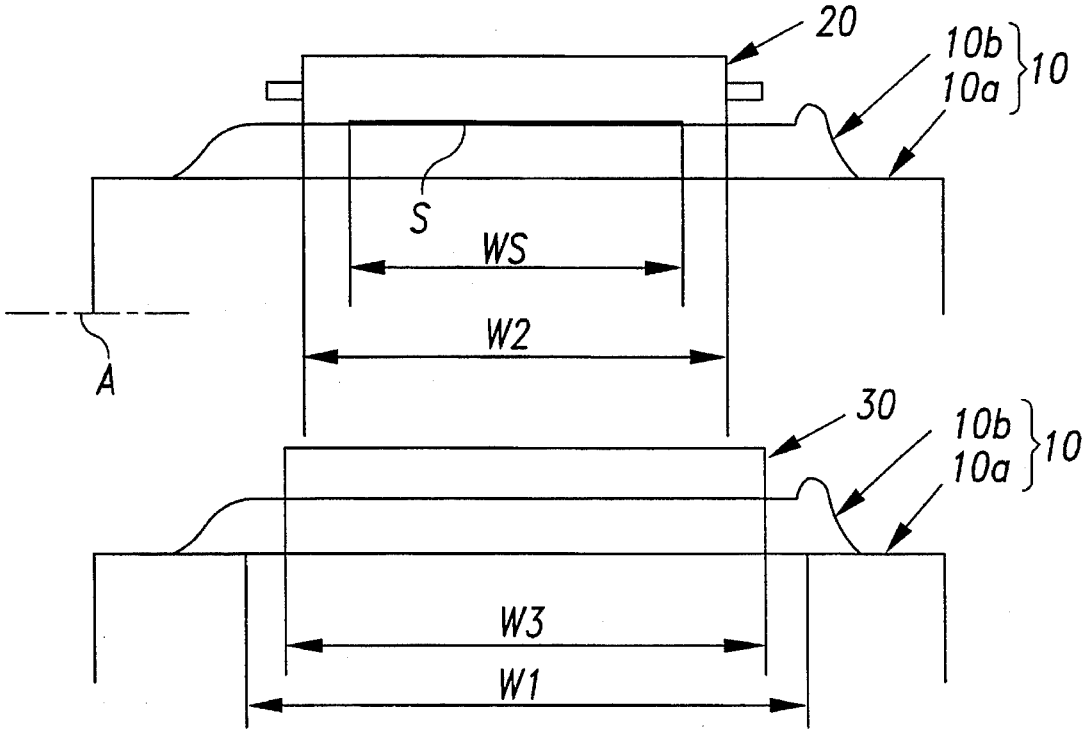
FIG. 1(B) shows, in its upper view, which is taken in a plane through the central axes of the image-bearing carrier and the transfer member, the width relationships of the transfer member, the transfer sheet, the dielectric or photoconductive layer and the electrically conductive substrate of the image-bearing member, and shows, in its lower view, the width relationships of the cleaning means, the dielectric or photoconductive layer and the electrically conductive substrate of the image-bearing member.
Figure 2:
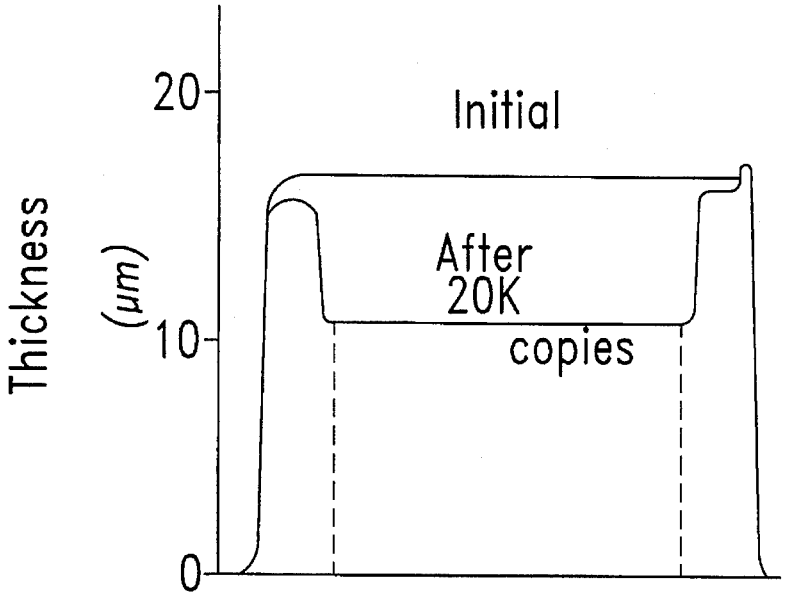
FIG. 2 shows the change in thickness of the dielectric or photosensitive layer that occurs due to wear by the cleaning blade with repeated printing.
Figure 3:
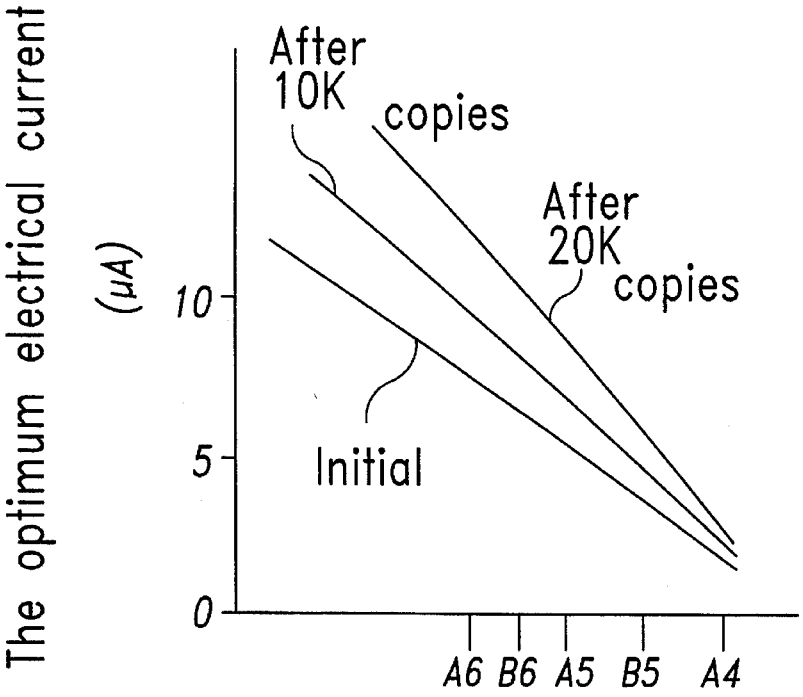
FIG. 3 shows the optimal constant-current values of a constant-current regulated power source for various transfer sheet widths and for changes in layer thickness of the dielectric or photoconductive layer due to wear in conjunction with printing.

A first embodiment of the present invention is described in detail hereinafter with reference to FIG. 1. FIG. 1(A) briefly shows the construction of a printer of the first embodiment. FIG. 1(B) shows the relationship in the aforesaid printer of the arrangement of width W1 of photosensitive layer 10*b* of photosensitive drum 10, width W3 of cleaning blade 30, and width W2 of transfer roller 20. FIG. 2 shows the change in layer thickness of photosensitive layer 10*b*, mainly due to wear by the cleaning blade by repeated printing. FIG. 3 shows the target constant-current values corresponding to wear (change in layer thickness) of photosensitive layer 10*b* in conjunction with the width of transfer sheet S and printing resistance, i.e., the target constant-current values of constant-current regulated power source 200 connected to transfer roller 20.

The printer of FIG. 1 is provided with photosensitive drum 10 which is rotatably driven at a circumferential speed (system speed) of 38 mm/sec in the arrow "a" direction by a drive means not shown in the drawing. Photosensitive drum 10 comprises an electrically conductive substrate 10*a* over which is sequentially superimposed an organic photosensitive layer 10*b* comprising a charge-generating layer and a charge-transporting layer.

Arranged sequentially around the periphery of photosensitive drum 10 are a charger 11, a developing device 12, a transfer roller 20, a cleaning blade 30, and an eraser 13. Image exposure unit 14 is disposed above photosensitive drum 10. A timing roller 15 is arranged on one side of transfer roller 20, and a transfer sheet transport deck 16 and a fixing roller 17 are disposed on the opposite side of transfer roller 20.

As shown in FIG. 1(B), the width of cleaning blade 30, and more specifically the length W3 in a direction parallel to rotational axis A of photosensitive drum 10, spans the image forming region within width W1 of photosensitive layer 10*b* of photosensitive drum 10. The width W2 of transfer roller 20 is narrower than both photosensitive layer width W1 and blade width W3, i.e., transfer roller 20 is arranged inside both widths W1 and W3.

At times the entire transfer roller 20 makes indirect pressure contact with photosensitive drum 10 through transfer sheet S depending upon the width WS of transfer sheet S. At times when the transfer sheet width WS is smaller than W2, a part of transfer roller 20 protrudes beyond transfer sheet S and makes direct pressure contact with photosensitive layer 10*b*, and the center portion of transfer roller 20 makes indirect pressure contact with photosensitive drum 10.

In operation of the aforesaid printer, the surface of photosensitive drum 10 is uniformly charged by charger 11, and laser light L emitted from the image exposure unit 14 irradiates the charged drum surface with a document image, so as to form an electrostatic latent document image thereby. The electrostatic latent image is developed by developing device 12 so as to produce a visible toner image. As the printer operates further, a transfer sheet S is fed from a paper supply unit not shown in the drawing, and transported to a transfer section by a timing roller 15 synchronously with the toner image formed on the surface of photosensitive drum 10. In the transfer section, a transfer bias is applied to transfer roller 20 from transfer bias power unit (constant-current regulated power source) 200 to transfer the toner image onto transfer sheet 20. After the toner image is transferred, transfer sheet S is transported to a fixing roller 17 by transport deck 16, the toner image is fixed thereon, and transfer sheet S is thereafter discharged outside the apparatus.

Residual toner remaining on the surface of photosensitive drum 10 is removed therefrom by cleaning blade 30, and the residual charge is removed therefrom by eraser 13.

In this printer, width W2 of transfer roller 20 is smaller than width W1 of photosensitive member 10, i.e., transfer roller 20 is arranged within width W1, and if transfer roller 20 makes direct pressure contact with the photosensitive layer 10*b* of photosensitive drum 10, the transfer roller resistance value is determined by the layer thickness of the photosensitive layer. If transfer roller 20 were to make contact with conductive substrate 10*a*, a transfer current 10~100 fold greater can flow leading to concern that marked transfer insufficiency may result; however, in this printer the transfer current flowing to transfer roller 20 can be suitably maintained by controlling the transfer current in accordance with width WS of the transfer sheet.

In the previously described printer, the layer thickness of photosensitive layer 10*b* of photosensitive drum 10 is initially about 16 μm. When $20\times10^3$ sheets are printed, the aforesaid photosensitive layer 10*b* is worn down, mainly by cleaning blade 30, as shown in the example of FIG. 2, such that the layer thickness is reduced. In addition to the aforesaid changes in layer thickness, the current flow increases at locations at which transfer roller 20 makes direct contact with photosensitive drum 10 outside of sheet S, and as a result, the transfer current flowing to sheet S is reduced, which causes transfer insufficiency. In the present invention, the transfer current changes in accordance with the layer thickness of the photosensitive drum, and in this instance when width W2 of transfer roller 20 is smaller than width W3 of cleaning blade 30 (i.e., when transfer roller 20 is disposed within width W3 of cleaning blade 30), the transfer current value can change in accordance with the transfer sheet size (width) in addition to changes in layer thickness of photosensitive layer 10*b*, whereby the current value accurately corresponds to changes in said layer thickness. The transfer current of the transfer bias can thus be changed so as to accomplish suitable transfer based on, at least, the layer thickness of the dielectric layer or photoconductive layer of the image-bearing member, and also on the transfer sheet width.

In the image forming apparatus described above, each section operates in accordance with instructions from control unit CONT which controls the operation of the entire printer.

Power source 200, which supplies a transfer bias to transfer roller 20, is a constant-current regulated power source capable of supplying a developing bias by a constant-current regulation method, which allows a selectable target constant-current value to be set.

Control unit CONT includes a central processing unit (CPU), memory and the like, and is connected to means (not shown in the drawing) for selecting transfer sheets of a suitable size in accordance with the original document size, magnification/reduction mode and the like. Photosensitive drum 10, charger 11, developing device 12, constant-current regulated power source 200, image exposure unit 14 and the like are operated in accordance with instructions from the control unit CONT.

The setting of the target constant-current value of constant-current regulated power source 200 is also accomplished via instructions from the control unit. This setting is accomplished in accordance the target constant-current values shown in FIG. 3 corresponding to transfer sheet width input in conjunction with the selection of A4, B5, A5, B6, A6, and the like, transfer sheet sizes, via operation panel P or a transfer sheet selection means, and corresponding to the total number of prints stored in the control section (initial, $10\times10^3$ (10 k) sheets, $20\times10^3$ (20 k) sheets, and the like) representing the change in layer thickness of photosensitive layer 10*b*.

A means for detecting dielectric layer thickness may be a layer thickness measuring device which measures layer thickness and outputs a corresponding measurement value, or may be a device of simplified construction which determines layer thickness by calculating the number of rotations, or calculating the rotation time of a rotating image-bearing member, and by experimentally determining the amount of reduction in layer thickness in accordance with the image forming apparatus used, or simply determining layer thickness by the number of image formations or the like, or such means may determine layer thickness by calculating the number of reciprocations or calculating the reciprocation time in the case of a reciprocating-movement image-bearing member.

A means for determining transfer sheet width may be a suitable component for a paper supply section which supplies the transfer sheet such, e.g., a transfer sheet width sensor such as a microswitch provided on a paper cassette or the like, or may be a transfer sheet detection means combined with a transfer sheet size setting switch provided on the operation panel of the image forming apparatus, or may be a transfer sheet width detection means combined with an automatic selection means when a means is provided for automatic selection of a transfer sheet of a suitable size corresponding to the document size, magnification/reduction mode and the like.

A means for changing the transfer current through the application of a constant-current regulated transfer bias in accordance with the thickness of the dielectric layer or photoconductive layer of the image-bearing member and width of the transfer sheet may include means for detecting said layer thickness, means for detecting transfer sheet width, and means for changing a target constant-current value of a constant-current regulated power source based on layer thickness information and sheet width information from said detection means.

The transfer current may change in a plurality of stages in consideration of continuous change in accordance with layer thickness, transfer sheet width.

As a result, when a toner image is transferred to transfer sheet S, the transfer current resulting from a transfer bias applied to transfer roller 20 from constant-current regulated power source 200 is changed to accomplish suitable transfer based on the layer thickness of photosensitive layer 10*b* of photosensitive drum 10, and the width of selected transfer sheet S, whereby superior images are formed by said means alone even with repeated printing.

The previously described printer operates at a system speed of 38 mm/sec. However, if system speed is different, the target transfer current value corresponding to said system speed, i.e., the target constant-current value of constant-current regulated power source 200 is increased or decreased in proportion to said different system speed, and similar effectiveness will be obtained.

Setting the constant-current value of constant-current regulated power source 200 may, of course, be accomplished based on not only the layer thickness of photosensitive layer 10*b*, and width of transfer sheet S, but also the type of transfer sheet such as an OHP transparency, plain paper or the like.

Although the aforesaid embodiment has been described in terms of a laser printer, it is to be understood that the present invention is also applicable to analog copiers, digital copiers, reader printers and the like. Furthermore, the present invention is applicable not only to an image-bearing member in the form of a photosensitive drum as described above, but also to a laminate member comprising a dielectric layer superimposed on an electrically conductive substrate.

In the image forming apparatus of the present invention, various configurations of transfer member may be used such as a transfer roller, transfer belt, transfer brush and the like.

Various configurations of cleaning members may be used such as a cleaning blade, cleaning brush or the like which contacts the image-bearing member.

The means for changing the aforesaid transfer current can change the transfer current not only based on the layer thickness of the dielectric layer or photoconductive layer of the image-bearing member and transfer sheet width alone, but the transfer current may also be changed based on the type of transfer sheet.

The present invention can thus provide an image forming apparatus, having a laminate image-bearing member comprising a dielectric layer or photoconductive layer superimposed on an electrically conductive substrate, a transfer member for making pressure contact with said image-bearing member, and a cleaning member for cleaning the surface of said image-bearing member through contact therewith, which forms an electrostatic latent image on the image-bearing member, develops the latent image into a visible toner image, and transfers the toner image from the image-bearing member to a transfer sheet passing through the contact-pressure nip portion between the image-bearing member and a transfer member by applying a constant-current regulated transfer bias voltage to said transfer member, and can clean the surface of the image-bearing member after the transfer using the cleaning member, the image forming apparatus accomplishing suitable toner image transfer regardless of the change in layer thickness of a dielectric layer or photoconductive layer of an image-bearing member, and also regardless of the width dimension of the transfer sheet.

What is claimed is:

1. A charging device for use in an apparatus in which a charged toner image is formed on a surface of an image carrier and then the toner image is transported from the carrier to a medium, said charging device comprising:

means for charging the medium while the medium is in contact with the charged toner image on the image carrier;

a constant-current source capable of applying a plurality of constant-current values to the charging means;

means for determining thickness of the surface of the image carrier; and means for varying the constant-current value of the constant-current source in response to the determined thickness of the surface of the image carrier.

2. The charging device as claimed in claim 1 wherein the determining means includes a counter for counting cycles of charging of the image carrier in order to determine the thickness of the surface of the image carrier.

3. The charging device as claimed in claim 1 wherein the varying means also varies the charging of the charging means in response to a size of the medium.

4. The charging device as claimed in claim 1 wherein the determining means determines the thickness of the surface of the image carrier in response to a number of charging cycles and the varying means also varies the charging of the charging means in response to a size of the medium being charged.

5. The apparatus as claimed in claim 1 wherein the varying means raises the constant-current value when the determining means determines the thickness of the surface of the image carrier is reduced.

6. A method for transferring a charged toner image from an image carrier to a medium, comprising the following steps of:

positioning a medium adjacent the charged toner image on the image carrier;

applying an electric field which is generated by a constant-current source to the medium while the medium is adjacent the charged toner image, said applied electric field being variable by varying a constant-current value of the constant-current source;

determining thickness of the surface of the image carrier; and varying the electric field by varying the constant-current value in response to the determined thickness of the image carrier.

7. The method as claimed in claim 6 further comprising varying the electric field in response to a size of the medium.

8. The method as claimed in claim 6 wherein the constant-current value is raised in the varying step, when the thickness of the surface of the image carrier is determined to be reduced in the determining step.

9. An apparatus for forming an image on a medium, comprising:

a dielectric carrier;

a device forming a charged toner image on the dielectric carrier;

a contact-charging roller for charging the medium while the medium is pressed against the charged toner image on the dielectric carrier;

a power source connected to the contact-charging roller in order to transfer the charged toner image from the carrier to the medium, said power source being capable of applying a plurality of constant-current values to the contact-charging roller;

means for determining thickness of a surface of the dielectric carrier; and a controller varying the constant-current value of the constant-current source in response to the determined thickness of the surface of the dielectric carrier.

10. The apparatus as claimed in claim 9 wherein the controller includes a memory for storing a relationship between numbers of times of image transfer and a change of the thickness of the dielectric carrier.

11. The apparatus as claimed in claim 9 wherein the dielectric carrier includes a surface including a binder resin and the apparatus further comprises cleaning means in contact with the dielectric carrier.

12. The apparatus as claimed in claim 9 wherein the device includes a charger for uniformly charging the dielectric carrier, an image exposure device for selectively discharging the uniformly charged surface to form a charge image on the dielectric carrier, and an applicator applying a charged toner to the charge image.

13. An image forming apparatus comprising:

a rotating image carrier having a dielectric surface;

an image forming device for forming a charged toner image on the dielectric surface;

a transporting device for transporting a medium toward a transfer position where the medium contacts the charged toner image formed on the dielectric surface of the image carrier;

a medium-charging roller at the transfer position for contacting the medium;

a cleaner contacting the dielectric surface of the image carrier to clean residual toner from the surface of the carrier;

a power source connected to the medium-charging roller in order to transfer the charged toner image from the carrier to the medium, said power source being capable of applying a plurality of constant-current values to the medium-charging roller;

means for determining thickness of the surface of the image carrier; and a controller varying the constant-current value of the constant-current source in response to the determined thickness of the surface of the image carrier.

14. The image forming apparatus as claimed in claim 13 further comprising means for inputting information on the medium to said controller, said controller controlling the constant-current value in response to the information on the medium.

15. The image forming apparatus as claimed in claim 13 further comprising a sensor for sensing a size of the medium, said sensor being connected with said controller, said controller controlling the constant-current value in response to the medium size sensed by the sensor.

16. The image forming apparatus as claimed in claim 14 wherein the information inputting means inputs information related to a material of said medium, and said controller controls the constant-current value in response to the medium material.

17. The image forming apparatus as claimed in claim 13 wherein the image forming device comprises:

a charger uniformly charging the dielectric surface of the rotating image carrier;

an image exposure device for selectively discharging the uniformly charged dielectric surface and creating a charge image on the dielectric surface; and an applicator for applying a charged toner onto the dielectric surface of the image carrier to form the charged toner image.

18. The image forming device as claimed in claim 13 wherein the medium-charging roller has a length shorter than those of the dielectric surface and the cleaner, said lengths being measured in a direction perpendicular to a rotating direction of the rotating image carrier.

19. The image forming device as claimed in claim 13, wherein the determining means comprises a counter for counting the medium transported by the transporting device, said controller controlling the constant-current value in response to the counter output.

20. The apparatus as claimed in claim 13 wherein the controller raises the constant-current value when the determining means determines the thickness of the surface of the image carrier is reduced.

21. In an image forming apparatus including means for forming a charged toner image on a wearable photosensitive carrier and means for transferring the charged toner image from the wearable photosensitive carrier to a transfer sheet with a constant-current source connected with the transfer sheet, the improvement comprising: said constant-current source being capable of applying a plurality of constant-current values to the transferring means, and further comprising means for determining thickness of the wearable photosensitive carrier due to wear and for varying the current applied to the transfer sheet by the constant-current source in response to the determined thickness of the wearable photosensitive carrier by the determining means.

22. The apparatus as claimed in claim 21 wherein said thickness determining means determines changes in thickness of the wearable photosensitive carrier and varies current applied to the transfer sheet in response to the thickness changes.

23. The apparatus as claimed in claim 21 further comprising means for determining a size of the transfer sheet and for further varying the current applied to the transfer sheet by the constant-current source in response to the size of the transfer sheet.

24. The apparatus as claimed in claim 21 further comprising means for varying the current applied to the transfer sheet by the constant-current source in response to information on transfer sheet material.

25. The apparatus as claimed in claim 21 wherein said thickness determining means determines changes in thickness of the wearable photosensitive carrier from a number of transfer sheets to which a charged toner image is transferred.

26. The apparatus as claimed in claim 21 wherein the constant-current source raises the constant-current value when the determining means determines the thickness of the wearable photosensitive carrier is reduced.

27. An image forming apparatus comprising:

an image carrier including a conductive substrate and a dielectric layer superposed onto the conductive substrate;

means for forming an electrostatic latent image onto the surface of the dielectric layer;

means for developing the electrostatic latent image by toner;

a transfer member being in contact with the surface of the dielectric layer, said transfer member and the image carrier forming a nip portion therebetween;

means for transporting a recording medium to the nip portion;

a constant-current power source capable of applying a plurality of constant-current values to the transfer member while the transfer member is in contact with the toner image on the image carrier in order to transfer the toner image from the surface of the dielectric layer to the recording medium;

means for determining a thickness of the dielectric layer;

means for detecting a width of the recording medium, said width being perpendicular to a transporting direction by the transporting means; and means for varying the constant-current value in response to the thickness of the dielectric layer determined by the determining means and the width of the recording medium detected by the detecting means.

28. The image forming apparatus as claimed in claim 27 further comprising a cleaning member being in contact with the surface of the dielectric layer wherein the transfer member has length shorter than those of the dielectric layer and the cleaning member in a direction perpendicular to the transporting direction of the recording medium.

* * * * *